United States Patent [19]

Harrington et al.

[11] 4,242,170

[45] Dec. 30, 1980

[54] PAPER WIRING TRANSPORT APPARATUS AND PROCESS

[75] Inventors: Duane E. Harrington, P.O. Box 31480, San Francisco, Calif. 94131; Merritt A. Robinson, Marin, Calif.

[73] Assignee: Duane E. Harrington, San Francisco, Calif.

[21] Appl. No.: 920,711

[22] Filed: Jun. 30, 1978

[51] Int. Cl.[3] ..... B65H 45/00

[52] U.S. Cl. ..... 156/438; 156/465; 156/176

[58] Field of Search ..... 156/176, 177, 178, 218, 156/433, 436, 444, 466, 438; 131/15 R, 35, 37, 260

[56] References Cited

U.S. PATENT DOCUMENTS

| | | | |
|---|---|---|---|
| 2,991,753 | 7/1961 | Dearsley | 131/37 X |
| 3,400,007 | 9/1968 | Rudszinat | 156/466 X |
| 3,437,093 | 4/1969 | Williamson et al. | 131/15 R X |
| 3,526,231 | 9/1970 | Verbakel | 131/15 R X |
| 3,619,328 | 11/1971 | Preston et al. | 156/436 |
| 3,660,206 | 5/1972 | Ortel | 156/176 X |
| 4,033,358 | 7/1977 | Harrington | 131/15 R |
| 4,166,300 | 9/1979 | Savich | 156/438 X |

*Primary Examiner*—George F. Lesmes
*Assistant Examiner*—Alexander S. Thomas
*Attorney, Agent, or Firm*—Bielen and Peterson

[57] ABSTRACT

A process and apparatus for attaching a wire to a paper including a paper feed mechanism for feeding paper across a fabrication station, a wire feed mechanism coordinated with the paper feed mechanism for feeding wire across the fabrication station in conjunction with the paper, an applicator for applying glue to the wire and a joining mechanism for joining the wire to the paper.

11 Claims, 7 Drawing Figures

PAPER WIRING TRANSPORT APPARATUS AND PROCESS

BACKGROUND OF THE INVENTION

This application relates to the copending application of Duane E. Harrington, entitled, "Paper Wiring Apparatus and Process", Ser. No. 921,103, filed June 30, 1978.

This invention relates to a process and apparatus for attaching a wire to a paper and is also related to U.S. Pat. No. 4,033,358, entitled "Cigarette Paper Holder Element", issued July 5, 1977. In the referenced patent a conceptual demonstration of one method of continuously integrating the wire into a continuous sheet of cigarette paper was included. While the method described therein was operably sound, certain problems arise when a device of that arrangement is operated at higher speeds. The process and apparatus described herein comprises an improvement over the device described in the referenced patent.

The apparatus and process of this invention can be utilized for multiple applications in addition to the principal use for installing a wire rolling and holder element into a cigarette paper. For example, the manufacture of common paper covered wire twists for closing bags and tying plants may be accomplished by selection of appropriate paper and wire in the fabrication process.

Since the apparatus is primarily designed to handle light weight paper used in cigarette manufacture and use, the handling capabilities inherent in a wire reinforced paper suggest a new areas of use. For example, the reinforcing wire element in cut paper sections can have a ferric characteristic for use in automated magnetic handling. Medical institutions performing repetitive filtering, staining or blotting tests may find a wire reinforced paper adaption both from the manual and the automated handling standpoint.

As mentioned, the method described in the reference is substantially improved for operation at higher speeds by the innovative techniques disclosed and claims herein. In the reference, wire is described as being delivered through a guide tube to the assembly bed. A liquid adhesive is supplied to the end of the guide tube. As shown the tube is funnel-like with an inside diameter substantially larger than the wire. In effect, the wire is drawn through a liquid adhesive bath. However, it has been found that at moderate operating speeds, bubbles in the adhesive, surface film on the wire or the surface tension of the liquid adhesive periodically prevent the adhesive from physically coating the wire. When the wire is applied to the paper there is consequently no adhesion along portions of the paper. When the wired paper is cut into segments, the wire may become wholly detached from the paper.

SUMMARY OF THE INVENTION

The problems discussed above which were generated by the newly devised high speed feed mechanism, are solved by the improvement described herein and claimed in a separate copending application.

It has been discovered that when the wire has been drawn through an elongated orifice only marginally larger than the wire diameter, the adhesive is forced into contact with the wire. It is believed that the adherence of the adhesive to the proximate wall of the elongated orifice substantially increases flow frictions and results in almost a brushing action to contact the adhesive with the wire. Furthermore, it has been discovered that supplying the adhesive under a moderate pressure prevents the transport of air bubbles along with the wire which cause voids in the adherence process in the elongated orifice.

In the present improvements the wire is drawn into a reduced diameter, elongated orifice or passage formed in the preferred embodiment by a blunt tube having a diameter preferably less than twice the diameter of the wire. The tube is useful in directing the wire to the proper location on the paper for joining the wire to the paper.

Other improvement in the feed mechanism arrangement enable a substantially increased accuracy in aligning the wire along the proper position on the paper. This is accomplished even at the increased operating speeds attainable by the improved adhesive method and improved feed mechanism arrangement.

DETAILED DESCRIPTION OF THE PREFERRED EMBODIMENTS

Figure 1:
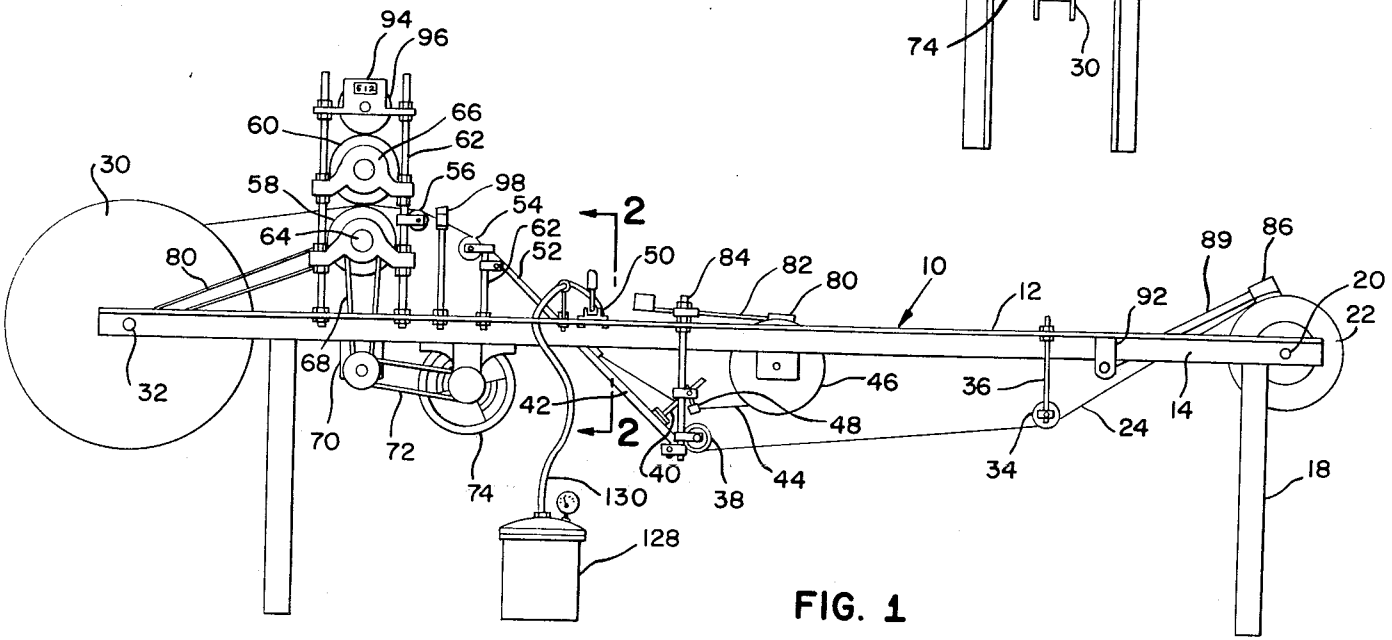
FIG. 1 is a side elevational view of a paper and wire feed mechanism.

The paper and wire feed mechanism of this invention is shown in FIG. 1 of the drawings and designated by the reference number 10. The feed mechanism 10 comprises a preferred embodiment of the invention which appropriately aids in describing the method or process of applying a wire element to a paper member practiced by the invention.

Figure 2:
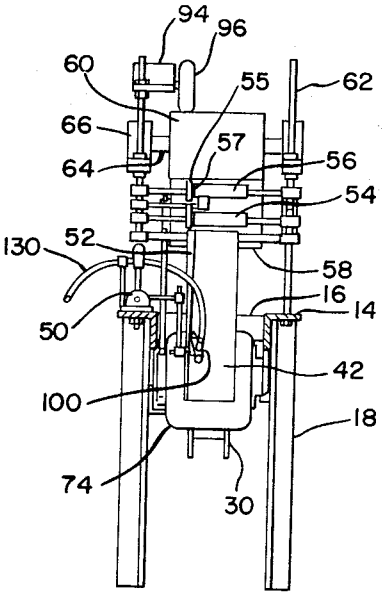
FIG. 2 is a cross sectional view of the feed mechanism taken on the lines 2—2 in FIG. 1.

The feed mechanism 10, shown in FIGS. 1 and 2, includes a support frame 12 comprising a pair of parallel horizontal frame members 14 interconnected by cross members 16 (one visible in FIG. 2) and supported by a spaced pair of leg members 18. At one end of the support frame 12 mounted on a spindle 20 is a supply bobbin 22 of paper 24. Paper 24 from the supply bobbin, is guided on a feed path by a series of guides to a wiring station 28 and eventually to a takeup bobbin 30 mounted on a spindle 32 at the opposite end of the support frame.

To detail the feed path, paper 24 unrolls from the top of the bobbin 22 to a first guide roller 34 mounted on a vertically adjustable bracket 36 to a second guide roller 38 at the beginning of the wiring station. After rounding the roller 38 the paper 24 engages an alignment guide 40 shown in greater detail in FIG. 7. The alignment guide prevents paper drift on the roller and properly orients the paper as it is transported across an incline bed 42 at the wiring station.

Concurrently with the transport of paper 24, a thin wire 44 from a spool 46 mounted between the frame members 14 is fed through a guide eye 48 and through an adhesive supply and wire dispensing mechanism 50. This mechanism is shown in greater detail in FIGS. 3, 4, 5, and 6 and discussed hereafter. After being coated with a thin layer of adhesive, the wire is directed at the paper and joined to the paper during a fold-over process operating along one edge of the paper.

The fold-over or overlap is accomplished by a wave guide 52 on the side of the incline bed 42, which gradually lifts and directs the edge of the paper over the wire. The resultant overlap is set by a pair of guide rollers 54 and 56 having a side flange 55 and surface groove 57 for locating the wire in the outer portion of the overlapped edge of the paper when the paper and wire travel over a portion of the curvature of the roller. The guide rollers are adjustable in height and pitch by variable height support brackets 62 in order to correctly position the paper on the bed 42, and the wire in the paper. Compression rollers 58 and 60 are arranged one over the other, and in mutual engagement for sealing the overlap. The rollers are preferably a solid, relatively hard, rubber or resilient rubber-like synthetic, except for a core journal 64 which is rotatably supported in a journal bearing 66. The journal bearings are also adjustably mounted on support columns such that the orientation and compression of the rollers can be varied. The wired paper is squeezed between the rollers 58 and 60 which firmly attaches the overlay of the paper to the wire, insuring a maximum adherence. Any excesses in glue are distributed by the squeeze rolling to prevent any minor glue bulges. The rollers 58 and 60 also comprise the transport means for the paper and wire. In this respect the lower roller 58 is connected by a drive belt 68 to a speed control transmission 70, which in turn is connected by a drive belt 72 to an electric motor 74.

The wired paper is fed to the takeup bobbin 30 which maintains a takeup tension by the connection of the bobbin spindle 32 to the roller journal of the lower roller 58 with a slip belt 80. The slip belt is preferably a large O-ring which allows adequate slippage to insure the takeup bobbin is always taking on the wired paper fed from the compression rollers regardless of the size of the roll of wound paper on the bobbin. This eliminates the necessity for complicated takeup gearing that must continually adjust to the size of the roll of wound paper on the bobbin.

Since the entire feed of the apparatus is generated by the compression rollers, it is necessary to provide a drag to the wire spool 46. This is most effectively accomplished by a drag shoe 80 at the distal end of a pivot arm 82 pivotally connected to a bracket 84 on the frame 12. Similarly, a drag shoe 86 at the distal end of the pivot arm 89 pivotally connected to a bracket 92 on the frame 12 provides a drag for the supply bobbin.

If desired, the drag shoes can be arranged with counter weights on the pivot arms to operate on the under side of the spool and bobbin. In either arrangement wire and paper may alternately be supplied from the underside of the respective spool and bobbin.

To monitor paper transport, a meter device 94 having a tracking wheel 96 indicates the length of paper transported. Further, an optical sensor 98 indicates the existence of paper in the transport path. The optical sensor 98 is connected to a motor switch to automatically shut down all transport once a break in the paper is sensed.

The wiring machine is designed to operate at paper speeds that may exceed eight feet per second. Because of the fine nature of cigarette paper, tearing can result if the apparatus is not finely tuned. Unless an operator is in attendance at all times the automatic shut down is necessary to prevent substantial wastes in paper.

While other sensors may be used, for example, tension sensors, or tension rollers connected to microswitches, the optical method is the most convenient and easily adaptable to the apparatus devised.

Figure 3:
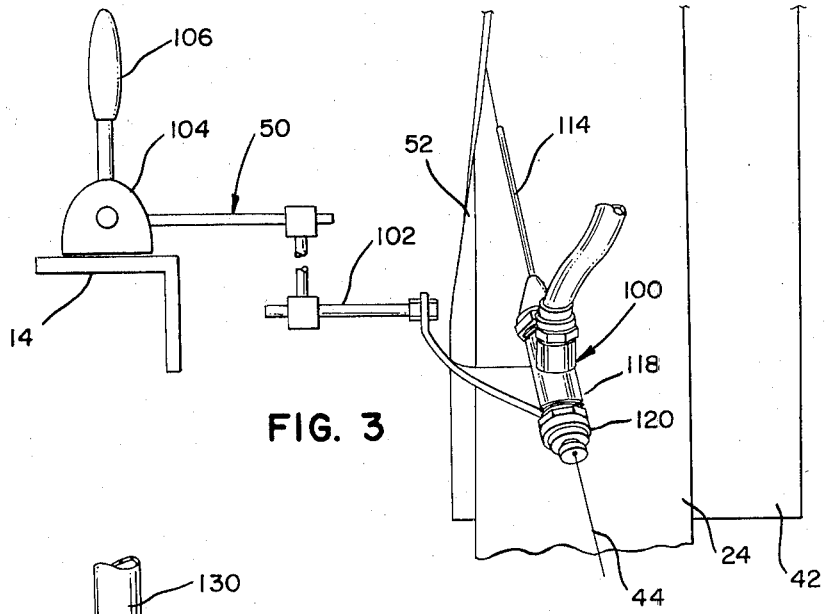
FIG. 3 is an enlarged end view of an adhesive supply and wire dispensing mechanism.
Figure 4:
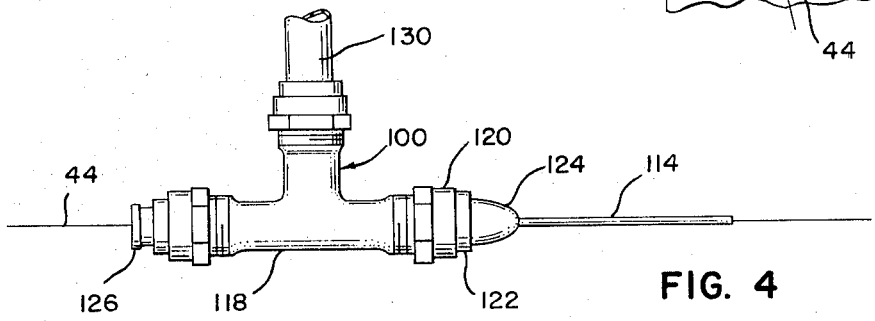
FIG. 4 is an enlarged side elevational view of an adhesive supply and wire dispensing component of the mechanism of FIG. 3.
Figure 5:
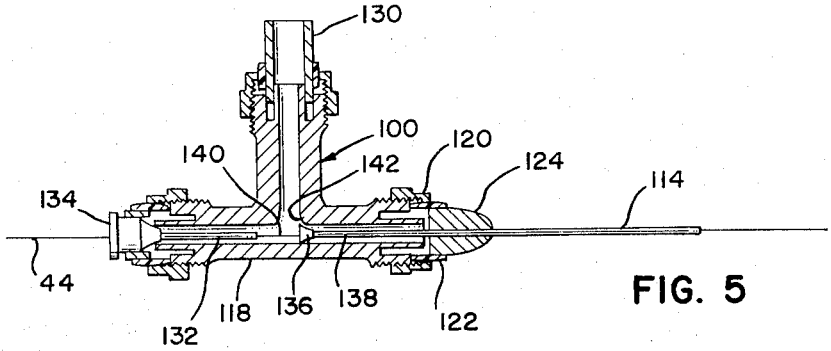
FIG. 5 is a cross sectional view of the adhesive supply and wire dispensing component of FIG. 4.

Referring now in greater detail to the adhesive supply and wire dispensing mechanism 50 shown in FIGS. 3, 4, and 5, the wire 44 is fed through a dispensing component 100 mounted at the end of an adjustable extension 102. The extension is pivotally connected to a bracket 104 mounted to one of the frame members 14. At the pivotal connection of the extension 102 to the bracket 104 the extension includes a lever 106 which enables extension and dispensing component to be pivoted into and out of position. This is particularly helpful when the machine has been stopped for adjustment, initial threading of paper on the transport path, or for other purposes where the mechanism would be in an interfering position.

The dispensing mechanism 50 shown in FIG. 3 is in its operating position with the dispensing component 100 positioned adjacent the edge of the paper, preferably where the paper has been curled by the wave guide 52 along one side of the bed 42 in the process of folding the paper over the wire.

Figure 7:
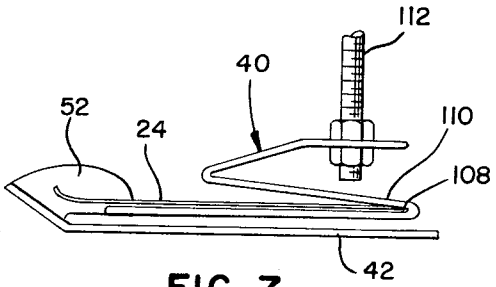
FIG. 7 is an enlarged cross sectional view of an alignment guide.

As mentioned, an alignment guide 40, shown in FIG. 7, is constructed with a thin plate bent to a "Z" configuration to provide a guiding edge 108 for the paper. The overlay 110 of the alignment guide inhibits the paper 24 from buckeling. The spacing between the paper 24, the guide 40 and the bed 42 is exaggerated in FIG. 7 for clarity. The guide 40 is connected to a bracket 112, threaded and having nuts for adjustment both in height and displacement.

The guide 40 forces the paper to commence its curl against the wave guide 52 along the edge of the bed 42.

The most advantageous position to couple the wire to the paper is approximately mid way along the wave guide 52 where the paper begins to fold over. To enhance the positioning of the wire and direct the wire against the paper at the proper point, the dispensing component 100 includes a projecting hollow tube 114. Because the tube should have a smooth inside wall that is no more than twice the diameter of the wire and preferably substantially less, and since the preferred size of wire for wired cigarette paper fabrication is fifteen thousandths of an inch, it has been found that a hypodermic needle with a flat ground end has the precision to function well as the projecting tube 114. With wire of the defined width, a No. 19 size needle functions optimally with moderately viscous adhesives such as gum arabic. Naturally adjustments in realtive size of the tube with respect to the size of the wire should be made in order to maintain a thorough coating without excess adhesive, particularly a condition that will cause adhesive to drop from the end of the tube and spot the paper.

The dispensing component 100, shown in FIG. 4 comprises a conventional tee-fitting 118 with threaded end couplings 120 having a plastic compression sleeve 122. At the lead end the projecting tube or needle is encased in a deformable support 124. At the trailing end wire 44 enters the head 126 of the hollow needle. Adhesive form a supply 128 in FIG. 1, is fed through a tube 130 under moderate pressure between 20 and 40 pounds to the top of the tee-fitting 118. The adhesive enters the projecting tube in the fitting and is extruded with the wire in a thin coating on the wire. The manner of insuring that glue contacts the wire in the tube or needle may be accomplished by alternate means. In the cross sectional view of FIG. 5, a double needle system is used. Here a feed needle 132 is fitted with its head 134 lodged in the trailing end of the fitting 118. The feed needle 132 is terminated at about the center of the fitting. Spaced from the end of the feed needle 132 is the head 136 of a second needle 138 which projects from the end of the fitting. Adhesive contacts the exposed portion 140 of the wire and enters the second needle 138 at its head 136. The head of the second needle is inhibited from movement in the direction of wire travel by the inside shoulder 142 of the fitting. The second needle can be moved in the opposite direction which is useful when initially feeding the end of the wire through the dispensing mechanism to insure that the wire is properly threaded. In the embodiment shown the size of the lead needle is slightly smaller than the second needle.

Figure 6:
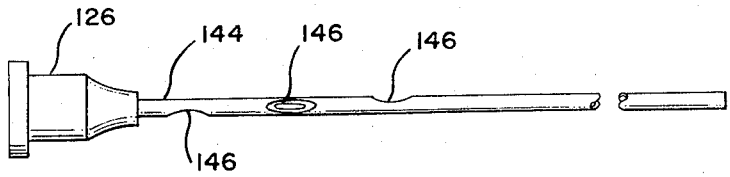
FIG. 6 is a cross sectional view of an alternate adhesive supply and wire dispensing component.

Alternately, as shown in FIG. 6, a single needle 144 having a series of ground perforations 146 can be substituted for the double needle system of FIG. 5. The needle is arranged with its head 126 position as the head 134 of the needle in FIG. 5. The perforated portion of the needle is located within the fitting and the remaining portion projects through the end support 124, as shown in FIG. 4. In this arrangement adhesive enters the perforations and is drawn with the wire through the needle.

The process for coupling a wire to a paper is effectively accomplished with the apparatus shown. While the wired paper is in this apparatus wound on a takeup bobbin for subsequent cutting at a separate station, it is readily apparent that a cutting operation can be integrated with the wiring operation with the wired paper going directly to a cutter from the pair of compression rollers. In some applications the latter integrated system is to be preferred. However, for certain products, such as paper coated wire ties, the product is preferably left on spools or bobbins until ultimate use by the consumer or in packaging some other product.

It is to be understood that certain modifications may be made to the apparatus shown according to a designers choice or in order to adapt it to a particular product without departing from the scope of the invention and coverage of the claims. In this respect is is clear that modifications in the wave guide on the bed and the alignment guide are necessary to handle paper of substantially narrower width than the cigarette paper shown.

What is claimed is:

1. Apparatus for improved continuous attachment of a wire to a paper comprising:

a. an elongated support structure, having a first end and a second end;

b. means for rotatably supporting a supply of paper at said first end of said support structure;

c. means for rotatably supporting a supply of wire at said first end of said support structure;

d. a fabrication station located generally between said first end and said second end of said support structure, said station including a substantially flat bed across which the paper is transported, said bed having means for overlapping one edge of the paper over the wire, said means comprising a wave guide mounted on said bed and engageable with one edge of the paper;

e. guide means for guiding wire from the wire supply to said fabrication station;

f. guide means for guiding paper from the paper supply to said fabrication station, said guide means including a paper alignment guide located at said fabrication station, said alignment guide engageable with an edge of the paper opposite the edge engageable with said wave guide;

g. means for applying adhesive to the wire at said fabrication station, said means including a discharge element through which wire is directed at said paper in the location of said wave guide;

h. means for coupling the wire to the paper at said fabrication station, said means including a curved member at the end of the bed with a surface curvature over which the wire and paper are transported in tension, wherein the overlapping is set by action of said surface curvature;

i. transport means at said second end engaging the coupled wire and paper for transporting the wire and paper across the fabrication station.

2. The apparatus of claim 1 wherein said curved member comprises at least one roller having a side flange for locating the overlapping edge of paper and a surface groove for locating the wire with respect to the overlapping edge of the paper.

3. The apparatus of claim 1 wherein said curved member comprises a first roller located adjacent the end of the bed and a second roller located adjacent the transport means.

4. The apparatus of claim 1 wherein said transport means comprises a first roller and a second roller mounted above and in engagement with said first roller, at least one of said rollers being drive coupled to a rotary drive means.

5. The apparatus of claim 4 wherein said drive means comprises an electric motor.

6. The apparatus of claim 1 comprising further a takeup roll located at said second end of said support onto which paper and coupled wire are wound.

7. The apparatus of claim 6 wherein said takeup roll includes a slippable drive belt connected to said transport means.

8. The apparatus of claim 1 wherein said bed has a lower end and an upper end, said paper guide means guiding paper onto said bed at said lower end and said wire guide means guiding wire over the paper wherein the wire is directed at the paper from the discharge element of said adhesive applicator means.

9. The apparatus of claim 1 wherein said means for applying adhesive to the wire includes an adhesive supply maintained under pressure.

10. The apparatus of claim 1 wherein said means for applying adhesive to the wire includes a structural support means for said discharge element, said support means being pivotally connected to said support structure for pivotal articulation of said tube into and out of an operating position.

11. The apparatus of claim 1 having further means for detecting the presence of paper transported through the wiring station.

* * * * *